US008661954B1

(12) United States Patent
Quayle

(10) Patent No.: US 8,661,954 B1
(45) Date of Patent: Mar. 4, 2014

(54) STOCK ALIGNMENT GAUGE FOR A TABLE SAW

(71) Applicant: William Buss Quayle, Wolfeboro, NH (US)

(72) Inventor: William Buss Quayle, Wolfeboro, NH (US)

( * ) Notice: Subject to any disclaimer, the term of this patent is extended or adjusted under 35 U.S.C. 154(b) by 0 days.

(21) Appl. No.: 13/709,830

(22) Filed: Dec. 10, 2012

(51) Int. Cl.
*B26D 7/06* (2006.01)
*B27B 27/02* (2006.01)

(52) U.S. Cl.
USPC ..... 83/448; 83/435.12; 83/435.14; 83/438

(58) Field of Classification Search
USPC ..... 83/435.11–435.15, 467.1, 468.1, 468.2, 83/425, 438–450, 468–468.7, 441.1; 33/471; 144/250.15, 253.6, 144.52
See application file for complete search history.

(56) References Cited

U.S. PATENT DOCUMENTS 1,862,002 A * 6/1932 Brungardt ..... 81/101
4,002,329 A * 1/1977 Petrowski ..... 269/318
4,026,173 A * 5/1977 Livick ..... 83/421
4,432,263 A * 2/1984 Kowalchuk ..... 83/438
4,454,793 A * 6/1984 Strong ..... 83/421
4,481,846 A * 11/1984 Goodell ..... 83/438
4,974,306 A * 12/1990 Cole et al. ..... 29/434
5,097,601 A * 3/1992 Pollak et al. ..... 33/471
5,176,058 A * 1/1993 Skelly ..... 83/415
5,215,134 A * 6/1993 Gudeman ..... 144/144.1
5,662,019 A * 9/1997 Denman ..... 83/425
6,672,190 B2 * 1/2004 Taylor ..... 83/435.14
7,017,464 B2 * 3/2006 Coderre ..... 83/446
7,240,706 B2 * 7/2007 Liu et al. ..... 144/286.5
2008/0277024 A1 * 11/2008 Kozina et al. ..... 144/253.6
2010/0307302 A1 * 12/2010 Smith ..... 83/13
2012/0125699 A1 * 5/2012 Guthrie ..... 177/225

* cited by examiner

*Primary Examiner* — Laura M Lee
(74) *Attorney, Agent, or Firm* — Fish & Richardson P.C.

(57) ABSTRACT

An apparatus for aligning stock to a blade of a table saw. The apparatus includes a substantially planar base plate, a guide slot bar coupled to a bottom surface of the base plate, and a stock alignment tool. The stock alignment tool includes a first substantially planar section having a straight edge and a second substantially planar section at a different height than the first substantially planar section, and the stock alignment tool is configured to be removably coupled to the substantially planar base plate to permit alignment of stock relative to the blade of the table saw. In addition, the guide slot bar is configured to be received within a guide slot of a table portion of the table saw.

9 Claims, 6 Drawing Sheets

STOCK ALIGNMENT GAUGE FOR A TABLE SAW

TECHNICAL FIELD

The following disclosure relates generally to woodworking.

BACKGROUND

Making precise angle cuts on a table saw is a tedious and inaccurate process. Present methods rely on coarse angle measurements indicated on a miter gauge to approximate the desired angle and aligning a piece of stock to the salvage side of the table saw blade's kerf by eye. This process can require several iterations to achieve the correct cut and replication of a particular cut is difficult at best. Additional inaccuracies may occur due to lateral movement of a miter gauge within a table saw guide slot while feeding stock.

SUMMARY

A cutting system including a stock alignment gauge and a stock feeding tool with a detachable miter fence is disclosed. The disclosed system the need to rely on degree markings on a miter gauge to measure angles, enables precise alignment of the stock to the salvage side of a table saw blade's kerf, and eliminates inaccuracies caused by lateral movement of a miter gauge within a guide slot while feeding stock.

In one aspect, an apparatus for aligning stock to a blade of a table saw includes a substantially planar base plate, a guide slot bar coupled to a bottom surface of the base plate, the guide slot bar configured to be received within a guide slot of a table portion of the table saw, and a stock alignment tool comprising a first substantially planar section having a straight edge and a second substantially planar section at a different height than the first substantially planar section, the stock alignment tool configured to be removably coupled to the substantially planar base plate to permit alignment of stock relative to the blade of the table saw.

Implementations may include one or more of the following. For example, the substantially planar base plate includes two threaded studs extending from a top surface of the base plate, wherein the stock alignment tool further includes two slotted openings each configured to receive one of the two threaded studs to couple the stock alignment tool to the substantially planar base plate. The guide slot bar further includes two beveled surfaces. The apparatus further includes two wedges insertable between the guide slot of the table portion of the table saw and each of the beveled surfaces of the guide slot bar to retain the guide slot bar in position relative to the blade of the table saw. The stock alignment tool is made of a substantially transparent material. The apparatus further includes two threaded lower discs, each of the lower discs coupled to respective ones of the threaded studs to support the stock alignment tool and permit height adjustment of the stock alignment tool, and two threaded upper discs, each of the upper discs coupled to respective ones of the threaded studs to retain the stock alignment tool in position.

In another aspect, an apparatus for feeding stock through a blade of a table saw includes a substantially planar base plate, and a guide slot bar coupled to a bottom surface of the substantially planar base plate, the guide slot bar configured to be received within a guide slot of a table portion of the table saw and comprising at least one arched leaf spring.

Implementations may include one or more of the following. For example, the guide slot bar further includes two or more tapped holes, the tapped holes located on a first surface, each of the tapped holes configured to receive a connecting element for adjustably attaching the guide slot bar to the substantially planar base plate, and wherein the substantially planar base plate further comprises at least two holes, each of the two holes configured to receive the connecting element for removably attaching the base plate to the guide slot bar. The at least two holes in the substantially planar base plate are aligned perpendicular to a blade side of the substantially planar base plate configured to allow multiple attachment points for coupling the guide slot bar to the substantially planar base plate. The apparatus includes a miter fence adjustably coupled to the base plate, the miter fence comprising a miter swivel comprising a substantially planar front face and a fence portion adjustably coupled to the substantially planar front face to permit alignment of the fence relative to the blade of the table saw. The fence portion includes two or more slots configured to receive a connecting element, and wherein the miter swivel includes two or more holes configured to receive the connecting element to adjustably couple the fence portion to the miter swivel.

In another aspect, a method for aligning and cutting stock on a table saw includes adjusting a first portion of a straight edge of a stock alignment gauge to contact a sawn surface of a piece of stock, adjusting a second portion of a straight edge of the stock alignment gauge to contact the sawn surface of the piece of stock, and securing the straight edge of the stock alignment gauge in place.

Implementations may include one or more of the following. For example, the method includes adjusting the height of the stock alignment gauge to a thickness of a piece of working stock. The method includes securing the stock alignment gauge within a guide slot of the table saw. The method includes using a set of wedges to retain the stock alignment gauge within the receiving slot of the table saw, each wedge of the set of wedges being inserted between a side wall of the guide slot and a beveled surface of a guide slot bar portion of the stock alignment gauge. The method includes aligning a cutting line scribed on a piece of working stock to the straight edge of the stock alignment gauge, and passing the working stock through the table saw blade. The piece of stock is taller than the adjusted height of the stock alignment gauge.

In another aspect, an apparatus for aligning stock to a blade of a table saw includes a substantially planar base plate comprising two threaded studs extending from a top surface of the substantially planar base plate, a guide slot bar coupled to a bottom surface of the substantially planar base plate, the guide slot bar configured to be received within a guide slot of a table portion of the table saw and comprising two beveled surfaces, a stock alignment tool comprising a first substantially planar section having a straight edge and a second substantially planar section coupled to the first substantially planar section through a substantially vertical section such that the second substantially planar section is at a different height than the first substantially planar section, the stock alignment tool comprising two slotted openings each configured to receive one of the two threaded studs to couple the stock alignment tool to the substantially planar base plate, and two wedges insertable between the guide slot of the table portion of the table saw and each of the beveled surfaces of the guide slot bar to retain the guide slot bar in position relative to the blade of the table saw.

Implementations may include one or more of the following. For example, the apparatus includes two threaded lower discs, each of the lower discs coupled to respective ones of the threaded studs to support the stock alignment tool and permit height adjustment of the stock alignment tool, and two threaded upper discs, each of the upper discs coupled to respective ones of the threaded studs to retain the stock alignment tool in position.

In another aspect, an assembly includes a first substantially planar base plate, a first guide slot bar coupled to a bottom surface of the first substantially planar base plate, the guide slot bar configured to be received within a guide slot of a table portion of the table saw, a stock alignment tool comprising a first substantially planar section having a straight edge and a second substantially planar section at a different height than the first substantially planar section, the stock alignment tool configured to be removably coupled to the first substantially planar base plate to permit alignment of stock relative to the blade of the table saw, a second substantially planar base plate, and a second guide slot bar coupled to a bottom surface of the second substantially planar base plate, the second guide slot bar coupled to the second substantially planar base plate and configured to be received within the guide slot of the table portion of the table saw.

DETAILED DESCRIPTION

Figure 1:
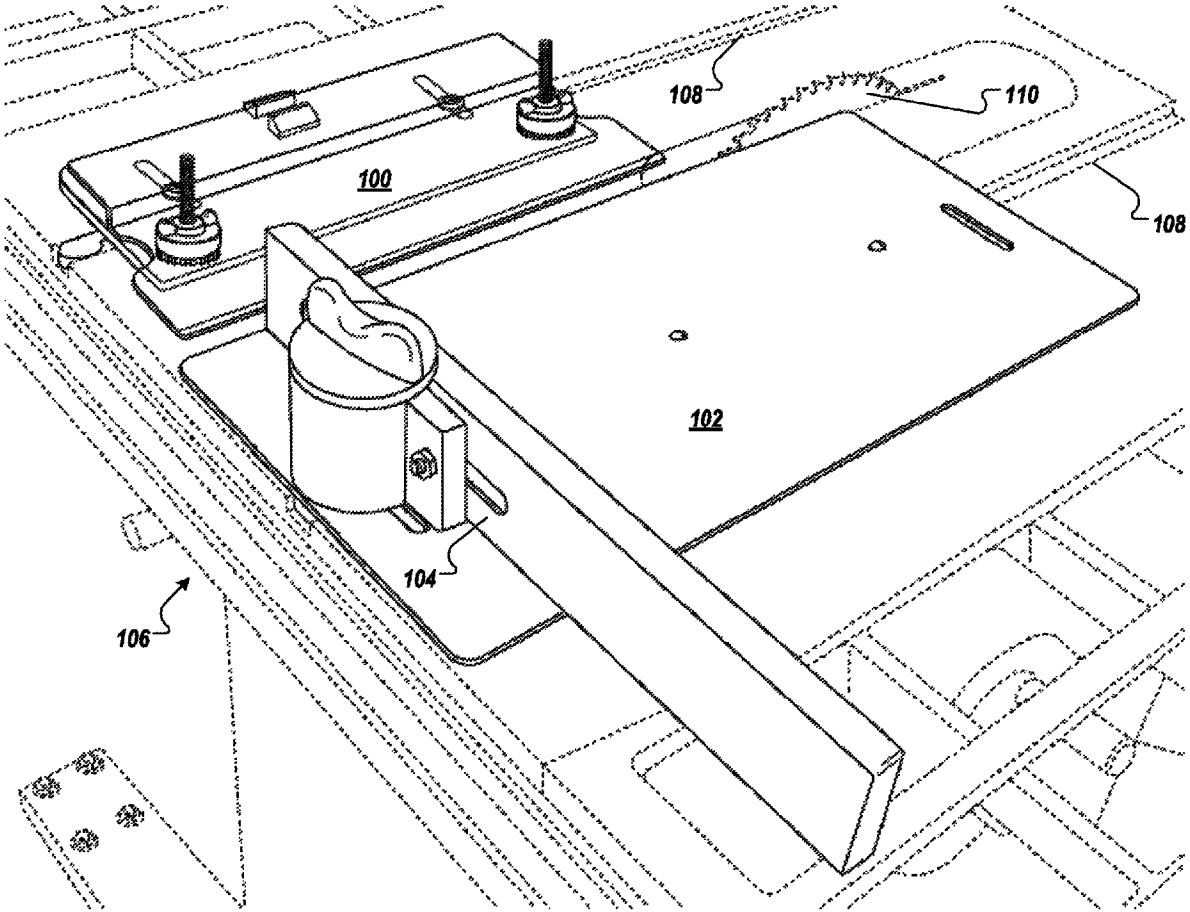
FIG. 1 illustrates an exemplary stock alignment gauge and stock feeding tool with a miter gauge.

FIG. 1 illustrates an exemplary stock alignment gauge 100 and stock feeding tool 102 with an attached miter fence 104. Together the stock alignment gauge 100 and the stock feeding tool 102 with the attached miter fence assembly 104 enable a user to quickly and accurately cut stock to any desired angle and limited length on a table saw 106. Both devices 100 and 102 may be positioned within either of the two guide slots 108 formed in the table saw 106.

The stock alignment gauge 100 is fixed within one of the table saw 106 guide slots 108, for example, in the left guide slot 108 as depicted in FIG. 1. The stock feeding tool 102 is movable within the opposite guide slot, for example the right guide slot 108. Both the stock alignment gauge 100 and the stock feeding tool 102 with the miter fence assembly 104 may be configured to be used in either the left or right guide slot 108 of a table saw 106, thus allowing a user to saw a piece of wood stock from either side of the blade.

The stock alignment gauge 100 allows accurate cuts of most angles by aligning the gauge 100 with the salvage side of the kerf produced in a sawn piece of stock. Alignment may be performed using a piece of scrap or test stock, for instance, to avoid wasting working stock. Once the stock alignment gauge 100 is adjusted, as will be described in more detail below, such that it is in contact with a sawn surface on a piece of stock along the entire length of the gauge 100, the gauge 100 is aligned with the salvage side kerf of the table saw blade 110 kerf. Any subsequent piece of stock may then be aligned with the edge of the stock alignment gauge 100 and the user is assured that his cutting line is accurately aligned with the salvage side of the saw blade 110 kerf.

Further cutting accuracy is achieved using the stock feeding tool 102 with the miter fence assembly 104 in conjunction with the stock alignment gauge 100. For example, the stock feeding tool 102 includes a guide slot bar configuration (described in reference to FIG. 3) that substantially eliminates all lateral movement perpendicular to the saw blade 110 while feeding stock through the table saw 110. The combined system of both devices working together enables a user to saw stock to such accuracy that a cutting line drawn on a piece of stock may be sawn precisely along its width for the entire length of the cutting line.

In lieu of the stock feeding tool 102, the stock alignment gauge 100 may also be used with a standard table saw miter gauge for cross cutting stock with the table saw 106.

Figure 2:
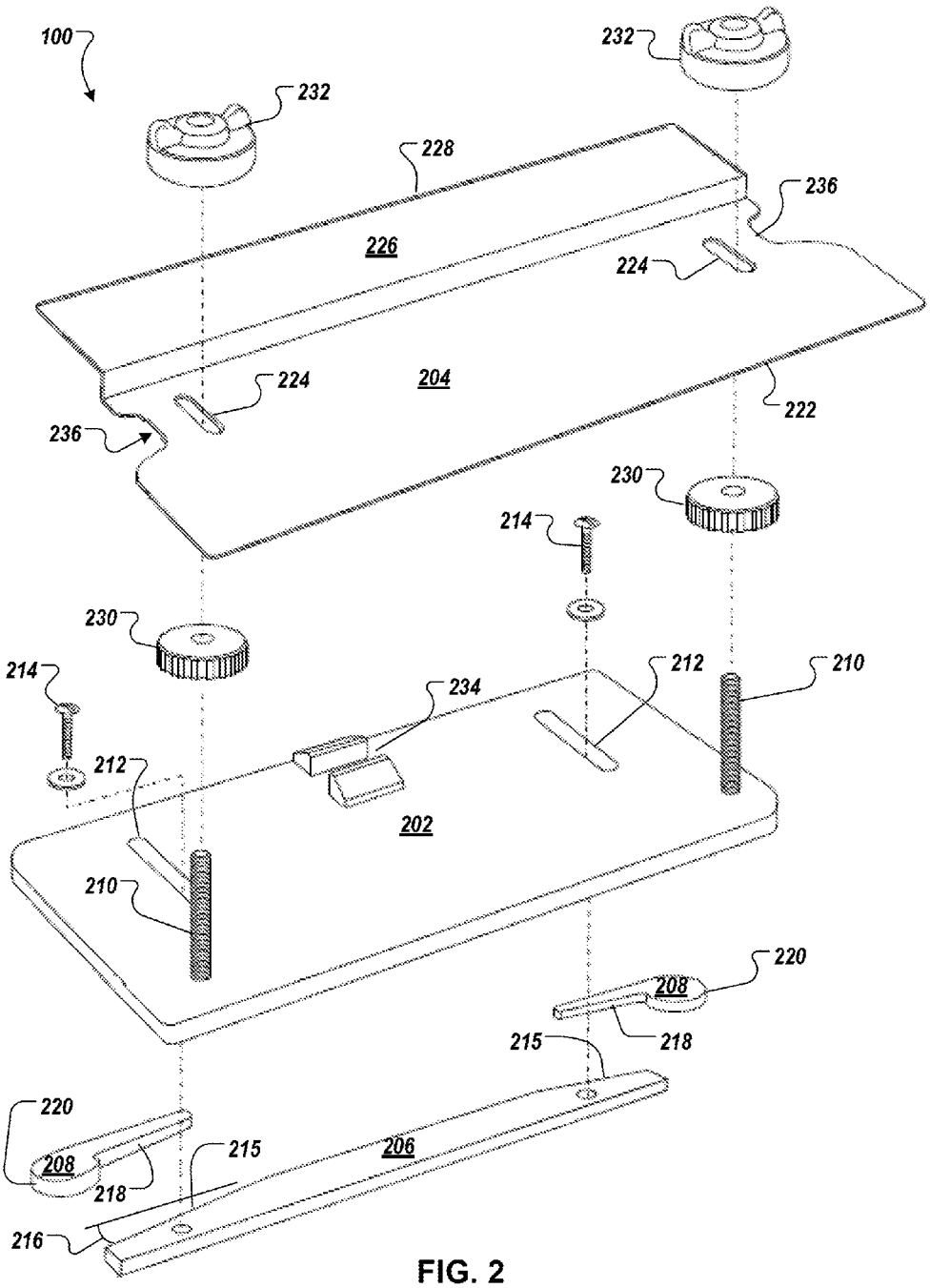
FIG. 2 is an exploded diagram of an example stock alignment gauge.

Referring to FIG. 2, the stock alignment gauge 100 includes a base plate 202, a stock alignment tool 204, a guide slot bar 206, and a pair of wedges 208.

The base plate 202 is substantially planar on both sides and may be constructed, for example, of wood, plastic, fiberglass, or any other suitable material. In an example implementation, the base plate is approximately 5 inches wide and 10.5 inches long. At least two threaded studs 210 protrude from the top surface of the base plate 202 at either corner nearest the blade. The studs are used to couple the stock alignment tool 204 to the base plate. In one implementation, the studs 210 are located on the saw blade side of the base plate 202, the saw blade side being that side of the base plate 202 which would normally be oriented towards the saw blade 110. In addition, the base plate 202 includes two slots 212 through which screws 214, for example, or another appropriate fastener, may be passed to attach the guide slot bar 206 to the base plate 202. The slots may be 2 inches in length, for example, and allow coarse lateral adjustment of the guide slot bar 206 underneath the base plate 202. Thus when the guide slot bar 206 is received in a guide slot 108 on the table saw 106 the base plate 202 may be adjusted laterally either towards or away from the saw blade 110 to accommodate the wide range of distances between table saw guide slots 108.

The guide slot bar 206 is configured to fit within the standard guide slots 108 of a table saw 106. In addition, the guide slot bar 206 includes a beveled surface 215 at each end. The surface 215 is beveled at angle 216 with respect to the parallel sides. When attached to the base plate 202, the guide slot bar may be oriented such that the beveled surfaces are facing opposite the stud 210 on the base plate 202, for example.

A pair of wedges 208 may be used to retain the stock alignment gauge 100 in place when installed on a table saw 106. For example, each wedge 208 is configured to be inserted between one sidewall of a table saw guide slot 108 and one of the beveled surfaces 215 of the guide slot bar 206. Thus installed, the wedges 208 will retain the stock alignment gauge 100 solidly in place with minimal pressure applied. One end of each wedge 208 may include a finial 220, allowing the wedges 208 to be easily pried away from the guide slot bar 206 and stock alignment gauge 100 to adjust or remove the stock alignment gauge 100 from the table saw 106.

In one implementation, the angle 216 is matched to the corresponding beveled surface 218 of equal angle on each of the wedges 208. When installed, the wedges 208, in such an implementation, may be oriented such that the corresponding beveled surfaces of the wedges 208 and the guide slot bar 206 are in contact. The angle 216 may be, for example, approximately 5 degrees, or between 5 and 6 degrees, or specifically 5.7 degrees. In addition, the guide slot bar 206 and the wedges 208 may be made of the same or similar material as the base plate 202. Alternatively, the guide slot bar 206 and the wedges 208 may be made from aluminum, steel, or any other suitable metal. Other methods for securing the stock alignment gauge 100 to a table saw 106 may also be used.

The stock alignment tool 204 is substantially planar and constructed of a substantially transparent material, for example, an acrylic glass or plastic. The stock alignment tool 204 includes a straight edge 222 to which wood stock may be aligned for sawing on table saw 106 and at least two slots 224. In one implementation, the stock alignment tool may be approximately 12 inches long, 5.75 inches wide and 0.093 inches thick.

Slots 224, which are used to couple the stock alignment tool 204 to the base plate 202, may each be, for example, 1-inch long. The base plate studs 210 may each be fitted with threaded lower discs 230 to support the stock alignment tool 204. The stock alignment tool 204 then rests atop the lower discs 230 with the studs 210 extending through the stock alignment tool slots 224 and the straight edge 222 oriented towards the blade side of the base plate 202. A threaded upper disc 232 is also fitted to each of the studs 210, and serves to retain the stock alignment tool 204 in place between the lower disc 230 and the upper disc 232 when screwed snuggly against the top surface of the stock alignment tool 204. Thus configured, the lower discs 230 and upper discs 232 may be used to adjust the height of the stock alignment tool 204 relative to the base plate 202, or to the deck of the table saw 106 if using a standard miter gauge, for example, to accommodate differing thicknesses of stock. In addition the slots 224 are configured to allow for lateral adjustment of the stock alignment tool 204 in a direction perpendicular to the saw blade 110, and thus, facilitate aligning the straight edge 222 with the saw blade 110 teeth for accurately sawing stock.

In another implementation, the stock alignment tool 204 may include a stepped up side 226 opposite the straight edge 222. The stepped up side 226 also may include a second straight edge 228. Such an implementation may be used for aligning and sawing thicker pieces of stock which would not fit under the stock alignment tool's 204 first straight edge 222. The straight edge in use may easily be changed by removing the stock alignment tool 204 from the base plate 202, rotating it 180 degrees, and re-installing the stock alignment tool 204 such that the stepped up side 226 is positioned on the blade side of the base plate 202 in order to accommodate thicker pieces of stock.

Other implementations may include a pair of blocks 234 for storing the wedges 208 on the backside (non-blade side) of the base plate 202. Other implementations may include indents 236 on both of the short sides (those sides running perpendicular to the table saw blade) of the stock alignment tool 204 to make lower discs 230 more accessible for finger adjustments. In another implementation, the straight edge 222 or 228 or both may be beveled to aid in aligning markings on stock with the straight edge (222 or 228).

Figure 3:
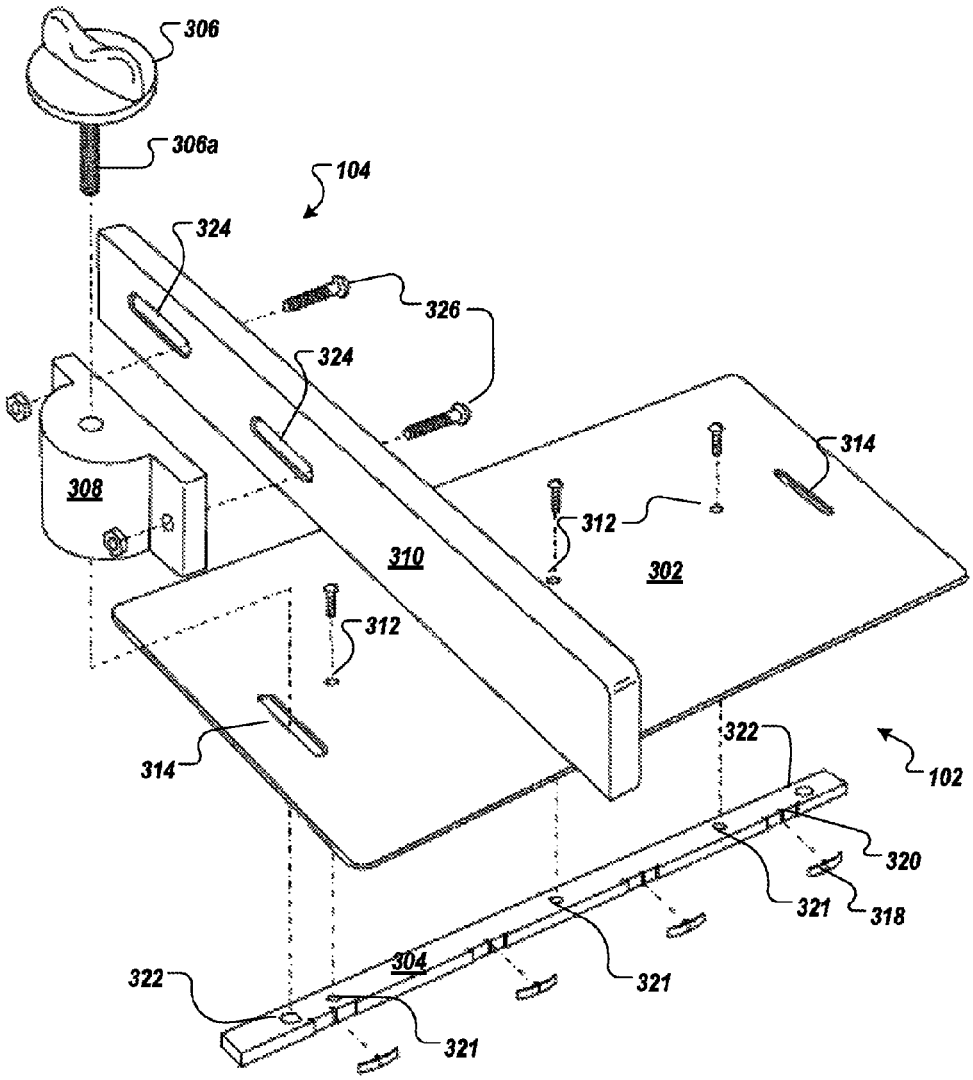
FIG. 3 is an exploded diagram of an example stock feeding tool and miter gauge.

FIG. 3 is an exploded diagram of an example stock feeding tool 102 and miter fence assembly 104. The stock feeding tool 102 includes a sled plate 302 coupled to a guide slot bar 304. A miter fence assembly 104 is removably attached to the stock feeding tool 102 by way of a miter fence lock 306 and the miter fence assembly 104 includes a miter fence swivel 308, a miter fence 310, and the miter fence lock 306.

The sled plate 302 (or base plate) is substantially planar on both sides and can be constructed of a thin sawable material, such as aircraft plywood or tempered fiber board, for example. In one implementation, the sled plate 302 is approximately 18 inches long and 9 inches wide. The sled plate 302 also includes two or more counter sunk holes 312 to facilitate attachment to the guide slot bar 304. The counter sunk holes 312 are aligned parallel to the long sides of the sled plate 302 and may be positioned substantially centered laterally between the long sides. In other implementations, the counter sunk holes 312 may be positioned off-center. In addition, the sled plate 302 includes two slots 314 at each end through which the miter fence lock 306 may be passed for attaching to the guide slot bar 304. A non-slip coating or surface may be applied to the top surface of the sled plate 302 and to the stock side of the miter fence 310, in some implementations, to prevent stock from sliding on the stock feeding tool 102 or miter fence 310 while being fed through the table saw 106.

The guide slot bar 304 is configured to slide within the guide slot 108 of a table saw 106 and includes two sets of tapped holes 321 and 322. Tapped holes 321 are configured to correspond with the countersunk holes 312 on the sled plate 302 and are used to attach the guide slot bar 304 to the sled plate 302. Furthermore, tapped holes 322 are aligned with slots 314 at either end to receive the threaded bolt portion of miter fence lock 306. In an example implementation, the sled plate 302 includes three countersunk holes 312 evenly spaced and aligned parallel to the long sides of the sled plate 302. In addition, the guide slot bar 304 includes three corresponding tapped holes 321 along its length. The guide slot bar 304 is attached to the sled plate 302 by use of flat head screws, or other suitable fasteners, passed through the counter sunk holes 312 into corresponding tapped holes 321.

To compensate for manufacturing tolerances and produce a tailored fit within the guide slot 108 on a wide range of table saws, the guide slot bar 304 includes at least two arched leaf springs 318 removably installed within a set of grooves 320 in the guide slot bar 304. The guide slot bar 304 may be configured to be slightly smaller than the narrowest guide slot 108 in a range of table saws. The arched leaf springs 318 then are configured such that, when the guide slot bar 304 is inserted in a wider guide slot 108, the arched leaf spring 318 is under less than maximum compression, thereby minimizing unnecessary lateral movement of the guide slot bar 304 within the guide slot 108. The guide slot bar 304 will be capable of securely fitting within the entire range of table saw guide slot dimensions because the guide slot bar 304 itself is sized to the narrowest guide slots 108 in the range.

Figure 5:
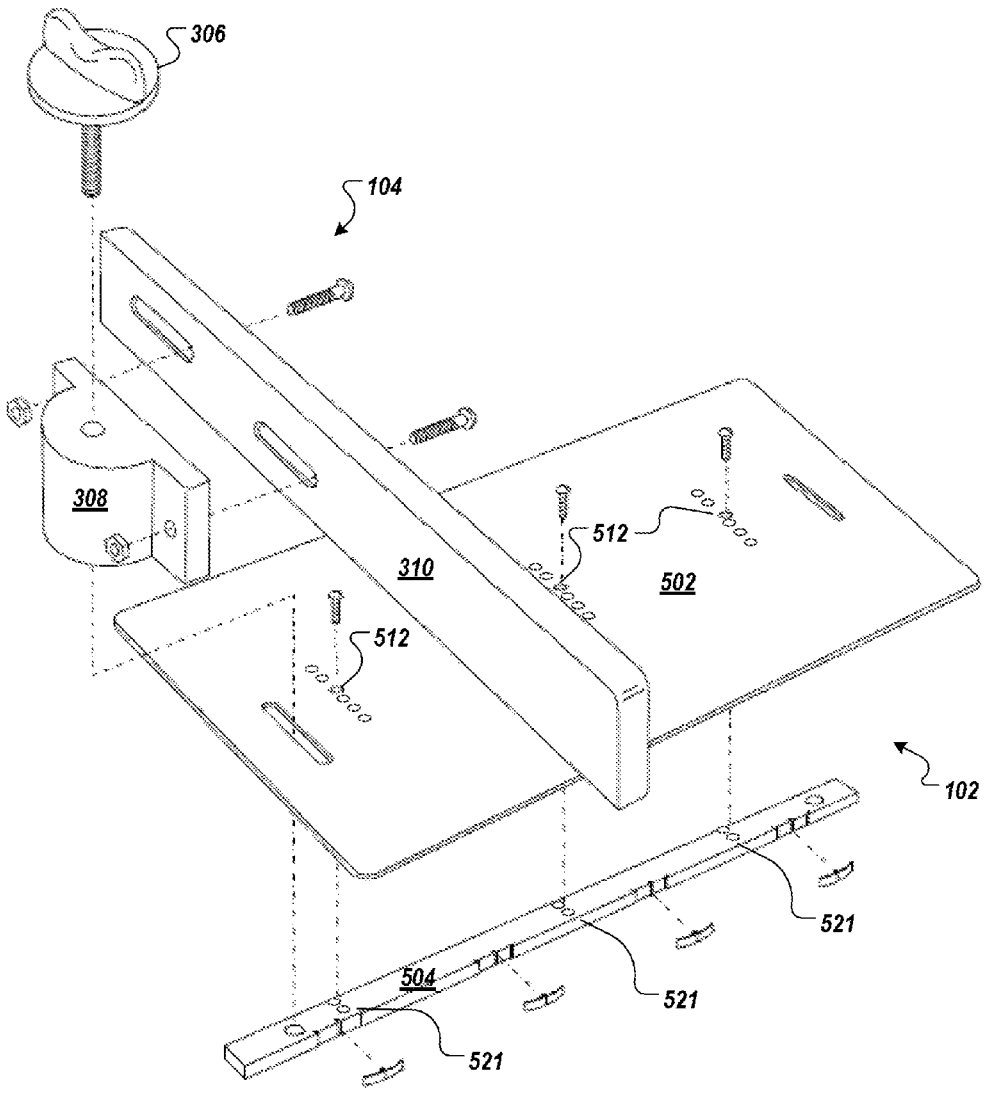
FIG. 5 illustrates an alternate baseplate and guide slot bar design for an example stock feeding tool.

Attaching the guide slot bar 304 to the sled plate 302 such that the leaf springs 318 are oriented towards the saw blade side of the guide slot 108 may enhance sawing accuracy. Doing so orients the solid side of the guide slot bar 304 away from the blade 110. By applying slight pressure down and away from the blade 110 while sawing, a user may be ensured of an accurate cut, because lateral movement of guide slot bar 304 within the table saw guide slot 108 is substantially eliminated. This is due to the arched leaf springs 318 providing a snug fit inside the guide slot 108 and the method of use ensuring that the solid side of the guide slot bar 304 is in contact with the outer vertical edge of the guide slot 108 during the entire cutting process. A user's safety is also improved, because if the user's hand were to slip while sawing it would most likely slip away from the blade 110. It should be noted that the guide slot bar 304 as depicted in FIG. 3 and FIG. 5 is oriented with the leaf springs 318 facing away from the blade side of the guide slot 108 for ease of reference and for illustrative purposes in order to show the detail of the arched leaf spring grooves 320. In practice, the guide slot bar 304 is oriented such that the leaf springs 318 are oriented towards the saw blade side of the guide slot 108.

In one implementation, the guide slot bar 304 is 18 inches long. In another implementation, the guide slot bar 304 may contain four arched leaf springs equally spaced along the length of the guide slot bar 304. In addition, the surface of the guide slot bar 304 opposite to the side housing the arched leaf springs 318 may include a low friction coating or material such as Teflon, for example. The guide slot bar may be made from aluminum, steel, or any other malleable material.

The miter fence assembly 104 includes a miter fence swivel 308, a miter fence 310, a miter fence lock 306. The miter fence swivel 308 is a geometrical block, such as a semicircular block, drilled through such that a close tolerance fit is established with the bolt portion of miter fence lock 306 and a flat wing extending from either side and configured to receive a fastener for attaching to miter fence 310. Miter fence 310 includes two slots 324 through which fasteners 326 are passed to attach to the miter swivel 308. The slots 324 are substantially centered vertically within the miter fence 310 making the miter fence 310 reversible, such that it may be used on either side of the table saw blade 110. The miter fence assembly 104 is attached to the stock feeding tool 102 by passing the threaded bolt portion 306*a* of miter fence lock 306 through the miter fence swivel 308 and slot 314, and screwing the threaded bolt portion 306*a* of miter fence lock 306 into taped hole 322 in guide slot bar 304.

In one implementation, fasteners 326 may be "T" bolts and the slots 324 may be counter bored and configured to receive "T" bolts 326. In addition the slots 324 allow the miter fence 310 to be adjusted laterally towards or away from the table saw blade 110 when the miter fence assembly 104 and stock feeding tool 102 are installed in a guide slot 108 of the table saw 106.

Figure 4:
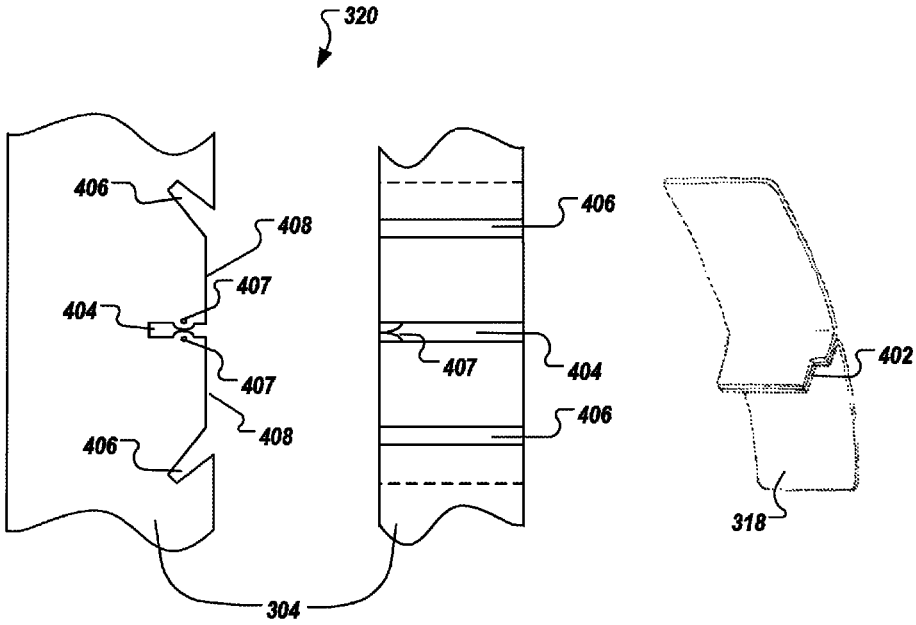
FIG. 4 illustrates a more detailed view of an arched leaf spring and corresponding grooves.

FIG. 4 illustrates a more detailed view of the arched leaf spring 318 and the grooves 320 formed in a side of guide slot bar 304. The arched leaf spring 318 is constructed of two opposite leaf springs bent in an "L" shape and coupled together (e.g. bonded together) to form a "T" shape. Such construction results in a double thick bonded leg extending away from the center of the concave side of the bonded spring. The arched leaf spring 318 may be constructed from beryllium copper, spring steel, or any other suitable material, for example. In one implementation a notch 402 is cut in one side of the center leg.

Grooves 320 cut into the guide slot bar 304 and include a center slot 404 and two angled slots 406 to house the arched leaf spring 318. The center slot 404 and angled slots 406 are cut sufficiently deep into the receiving portions of guide slot bar 304 to allow for flexing of the arched leaf spring 318. When relaxed, the two concave ends of the arched leaf spring 318 slide into the angled slots 406 and the center leg into the center slot 404. In one implementation, the center slot 404 is up-set slightly and configured such that the up-set portion 407 of the center slot 404 corresponds with the notch 402 in the arched leaf spring to retain the arched leaf spring 318 during use. In such an implementation, when the guide slot bar 304 is attached to the sled plate 302, the arched leaf springs 318 are completely retained in position in all directions. Additionally, the front face portion 408 of the slotted area may be inset from the side of the guide slot bar 304, for example.

FIG. 5 illustrates an alternate sled plate 502 and guide slot bar 504 design for an example stock feeding tool 102 with a removable miter fence assembly 104. In this alternate implementation, the set of single countersunk holes 312 (FIG. 3) in the sled plate 302 is replaced with two or more series of aligned and equally spaced counter sunk holes 512 in the sled plate 502; for example, six holes per series. This configuration allows for lateral adjustment of the sled plate's position relative to the saw blade 110. An alternate implementation of the guide slot bar 504, allows for more precise adjustments. The guide slot bar 504 includes replacing each of the tapped holes 321 (FIG. 3) with a set of two tapped holes 521. A wide arrange of adjustments is made possible by placing the countersunk holes in each series 512 at a different spacing interval than the spacing interval between the set of two tapped holes 521. For example, in an implementation including six countersunk holes in each series of holes 512 a total of twelve different adjustment positions are possible.

Figure 6:
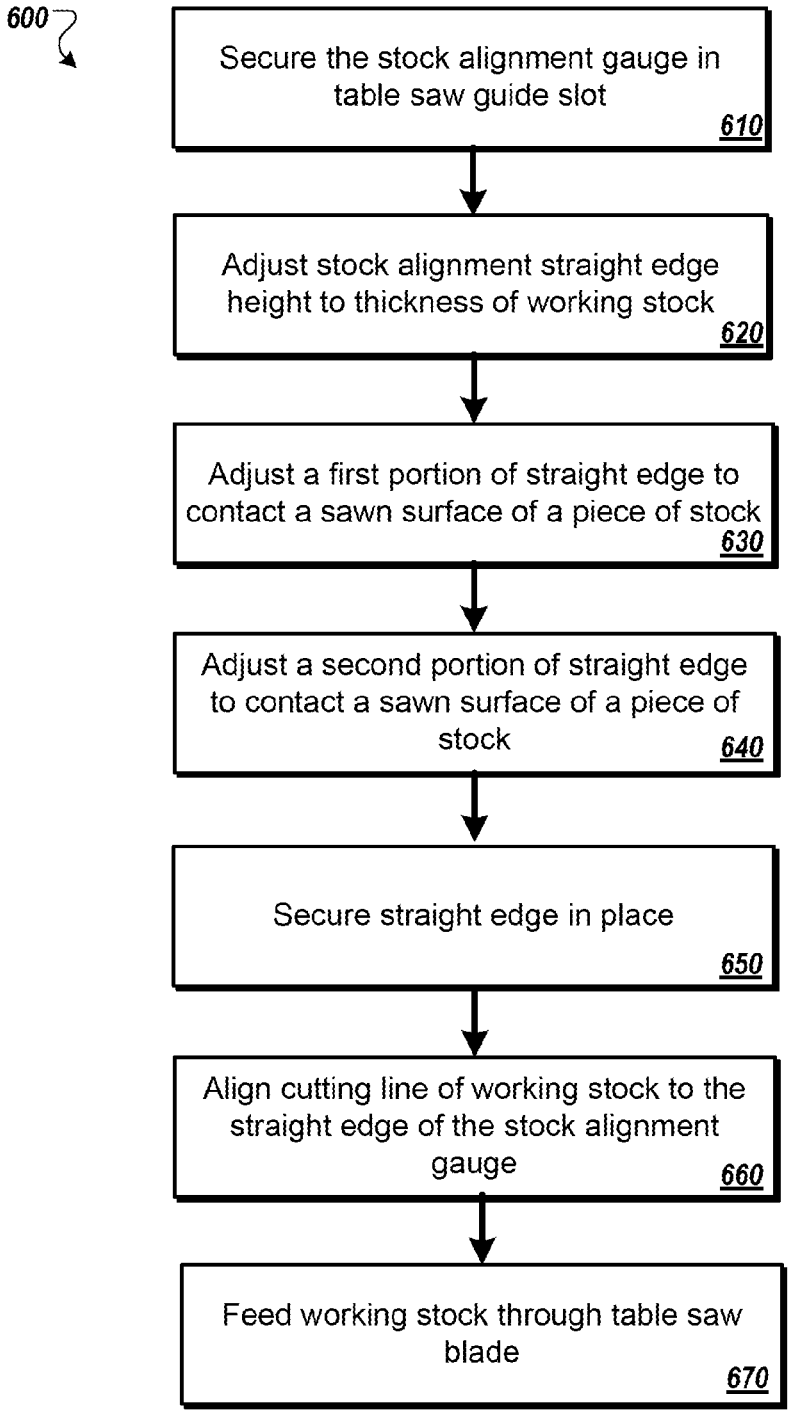
FIG. 6 is a flowchart showing an example process for using a stock alignment gauge and a stock feeding tool.

FIG. 6 is a flowchart showing an example process 600 for using a stock alignment gauge 100 and a stock feeding tool 102 with a removable miter fence assembly 104.

The process 600 includes securing the stock alignment gauge 100 within a table saw guide slot 108 (610). Securing the stock alignment gauge 100 within a table saw guide slot 108 (610) includes placing the stock alignment gauge 100 on either side of the table saw blade 110 by inserting the guide slot bar 206 into the appropriate guide slot 108 with the stock alignment gauge 100 oriented such that the bolt side of the base plate 202 faces the table saw blade 110 but clear of any safety shields. The base plate 202 should be positioned axially along the length of the guide slot 108 such that the corner of the stock alignment tool 204 including one end of the straight edge 222 is near the blade 110. To retain the stock alignment gauge 100 in position, wedges 208 are inserted at either end of the guide slot bar 206 and oriented such that the beveled surface 218 of the wedges 208 is in contact with the beveled surface 215 of the guide slot bar 206. In implementations including straight edge 228, stock alignment tool 204 may be oriented such that either straight edge (222 or 228) is facing the saw blade 110 (e.g. straight edge 222 for thinner stock or straight edge 228 for thicker stock). Throughout the remaining description reference will be made to straight edge 222 with the understanding that the process is identical for aligning and using straight edge 228.

Adjusting the stock alignment tool 204 height to the thickness of the desired working stock (620) includes placing the stock feeding tool 102 into the guide slot 108 on the opposite side of the blade 110 from the stock alignment gauge 100. The stock feeding tool 102 is placed on the table saw 106 so that the arch leaf springs 318 are oriented towards the blade 110 and the guide slot bar 304 is inserted into the guide slot 108. Next, a piece of working stock is placed on top of the stock feeding tool 102 and underneath the stock alignment tool 204 on the stock alignment gauge 100. The lower support discs 230 are adjusted up or down until the stock alignment tool 204, resting upon the lower support discs 230, is just coincident with the top surface of the working stock. Then, the upper support discs 232 are installed (if not done so already). The upper support discs 232 may be adjusted to be in contact with the upper surface of the stock alignment tool 204, but not tightened.

In some implementations, the sled plate 302 may require adjustment laterally so that it is as close to the saw blade 110 as possible. If using the stock alignment tool 102 for the first time on a particular table saw, it may be desired to customize the stock feeding tool 102 to the particular table saw. Customization may be accomplished, for example, by adjusting the sled plate 302 laterally such that a small portion of the sled plate 302 is within the blade's kerf and passing the stock feeding tool 102 through the table saw, thus sawing off a portion of the sled plate 302.

The steps for aligning (or calibrating) the stock alignment gauge 100 to the blade 110 include adjusting a first portion of the straight edge 222 on the stock alignment gauge 100 to contact a sawn surface of a piece of stock (630), adjusting a second portion of the straight edge 222 on the stock alignment gauge 100 to contact a sawn surface of a piece of stock (640), and securing the stock alignment tool 204 in place on the stock alignment gauge 100 (650). A piece of stock, scrap or test stock for example, that is taller than the adjusted height of the stock alignment gauge 100 should be used for aligning the stock alignment gauge 100. The piece of stock should be clamped to the miter fence assembly 104 on the stock feeding tool 102 to prevent unintended lateral movement. The stock is then fed through the table saw while maintaining pressure on the stock downward and away from the blade 110. As stated above, maintaining pressure downward and away from the blade 110 while feeding stock enhances sawing accuracy and safety.

After sawing the piece of stock, and without removing it from the table saw 106, it is drawn backwards until it is even with a first portion of the straight edge 222 and the stock alignment tool 204 is adjusted laterally so that the first portion of the straight edge 222 is in contact with the sawn surface on the salvage portion of the stock (630). The stock is then adjusted until it is even with the second portion of the straight edge 222 and the stock alignment tool 204 is adjusted laterally so that the second portion of the straight edge 222 is in contact with the sawn surface on the salvage portion of the stock (640), while retaining the first portion steady. Steps (630) and (640) may be repeated until the entire length of the straight edge 222 is in contact with the sawn surface on the salvage portion of the stock. Once aligned, the stock alignment tool 204 is secured in place (650) by snugly tightening upper discs 232 onto the top surface of the stock alignment tool 204.

The first portion of the straight edge 222 may be either the end closest to the blade 110 or the end farthest from the blade 110. Likewise, the second portion of the straight edge 222 may also be either end but generally will be opposite the end chosen as the first portion.

Steps associated with the use of the stock alignment gauge 100 and the stock feeding tool 102 with miter fence assembly 104 include aligning a cutting line on a piece of working stock with the straight edge 222 of the stock alignment tool 204 (660) and passing the piece of working stock through the table saw blade (670). A user may first draw or scribe a desired cutting line on a piece of working stock, for example, using a pencil, pen, marking knife, or other similar device. The working stock is then placed on the stock feeding 102 tool underneath the stock alignment gauge 100 and the cutting line aligned with the straight edge 222 (660) for the entire length of the straight edge 222. The cutting line may be aligned such that half of the line is under the stock alignment tool 204 in such a way that the straight edge "splits" the cutting line, for example. The stock is then fed through the table saw blade 110 while maintaining both cutting line in alignment with the straight edge 222 and pressure on the working stock directed downward and away from the blade.

Steps (660) and (670) may be performed with or without the miter fence assembly 104 attached to the stock feeding tool 102. The miter fence assembly 104 may be removed, for example, while ripping long and wide pieces of stock.

Because the sawn surface of the stock represents a plane created by the salvage side kerf of the saw blade 110, steps (630) and (640) ensure that the straight edge 222 is within that plane and therefore any piece of working stock aligned with the straight edge is also in the same plane with the salvage side saw blade 110 kerf. The result is that the user is assured that his working stock is accurately aligned with the saw blade 110 to produce an accurate and repeatable cut.

Each of the sub-processes of aligning the stock alignment gauge 100 to the saw blade 110, installing on the table saw 106, and using the stock alignment gauge 100 and the stock feeding tool 102 with the removable miter fence assembly 104 may be performed in separate steps from the process as a whole or each may be repeated with no need to repeat a separate sub-process.

A number of implementations have been described. Nevertheless, it will be understood that various modifications may be made without departing from the spirit and scope of the disclosure.

The invention claimed is:

1. A system for aligning stock and feeding stock to a blade of a table saw comprising:

a stock aligning assembly comprising:

a substantially planar base plate including a top and a bottom surface;

a guide slot bar removably coupled to the bottom surface of the substantially planar base plate, the guide slot bar configured to be received within a first guide slot of a table portion of the table saw and including two beveled surfaces configured to cooperate with two wedges insertable between the two beveled surfaces of the guide slot bar to retain the guide slot bar in position relative to the blade of the table saw;

at least two threaded studs extending from and substantially perpendicular to the top surface of the substantially planar base plate;

threaded lower support discs adjustably attachable to the threaded studs to allow for height adjustment relative to the top surface of the substantially planar base plate;

a stock alignment tool comprising a first substantially planar section having a straight edge and defining slotted openings therethrough and a second substantially planar section parallel to and at a different height than the first substantially planar section, the stock alignment tool configured to receive the at least two threaded studs through respective ones of the slotted openings in the first substantially planar section and to rest on the lower support discs permitting alignment of the straight edge of the stock alignment tool relative to a salvage side of a kerf of teeth surface on the blade such that in use the straight edge of the stock alignment tool aligns to be coplanar with the salvage side of the kerf of the blade's teeth surface; and threaded upper retention discs that cooperate with the lower support discs to retain the straight edge of the stock alignment tool in position relative to the salvage side of the kerf of the blade's teeth surface, the upper retention discs adjustably attachable to the threaded studs; and a stock feeding assembly comprising:

a substantially planar stock feeding base plate including at least two holes configured to receive screws; and a stock feeding guide slot bar configured to be received within a second guide slot of the table portion of the table saw comprising:

two or more threaded holes located on a first surface of the stock feeding guide slot bar, each of the threaded holes aligned with respective ones of the at least two holes in the substantially planar stock feeding base plate and configured to receive the screws for adjustably attaching the stock feeding guide slot bar to a bottom surface of the substantially planar stock feeding base plate, at least two arched leaf springs, each of the at least two arched leaf springs comprising an arch shaped spring member including an outer convex surface and an inner concave surface and a member extending from the substantial center of the inner concave surface; and a miter fence adjustably coupled to the substantially planar stock feeding base plate, the miter fence comprising:

a miter swivel coupled to the substantially planar stock feeding base plate and including a substantially planar front face and two or more holes; and a fence portion adjustably coupled to the substantially planar front face of the miter swivel and including slots configured to receive connecting members aligned with the two or more holes in the substantially planar front face of the miter swivel.

2. A system for aligning stock and feeding stock to a blade of a table saw, the system comprising:

a stock aligning assembly comprising:

a substantially planar base plate;

a guide slot bar coupled to a bottom surface of the base plate, the guide slot bar configured to be received within a first guide slot of a table portion of the table saw;

a stock alignment tool comprising a first substantially planar section having a straight edge and a second substantially planar section at a different height than the first substantially planar section, the stock alignment tool configured to be removably coupled to the substantially planar base plate to permit alignment of stock relative to the blade of the table saw; and a stock feeding assembly comprising:

a substantially planar stock feeding base plate; and a stock feeding guide slot bar coupled to a bottom surface of the substantially planar stock feeding base plate, the stock feeding guide slot bar configured to be received within a second guide slot of a table portion of the table saw, the stock feeding guide slot bar comprising at least two arched leaf springs, the at least two arched leaf springs comprising an arcuate-shaped spring member including an outer convex surface and an inner concave surface, and a member extending from the substantial center of the inner concave surface, the stock feeding guide slot bar further comprising at least two sets of grooves configured to retain respective ones of each of the arched leaf springs within the stock feeding guide slot bar, each of the at least two sets of grooves comprising a first angled slot and a second angled slot configured to receive a first and a second side of the arched leaf spring member, and a center slot configured to receive the arched leaf spring member extending from the substantial center of the inner concave surface, and wherein the at least two arched leaf springs are retained within the sets of grooves such that the outer convex surface is oriented away from the stock feeding guide slot bar.

3. The system of claim 2, wherein the stock alignment tool is made of a substantially transparent material.

4. The system of claim 2, wherein the at least two arched leaf springs further comprise a notch defined in a bottom side of a distal end of the arched leaf spring center member, and wherein the center slot of the sets of grooves further comprises an up-set portion, the up-set portion located on an area of the center slot that is coincident with a bottom surface of the stock feeding guide slot bar, and wherein the at least two arched leaf springs are retained within the sets of grooves such that the notch is aligned with the up-set portion of the center slots of the sets of grooves.

5. The system of claim 2, wherein the outer convex surface of the at least two arched leaf springs is coated with a low friction coating.

6. The system of claim 2, wherein the stock feeding guide slot bar further comprises two or more tapped holes, the tapped holes located on a first surface of the stock feeding guide slot bar, each of the tapped holes configured to receive a connecting element for adjustably attaching the stock feeding guide slot bar to the substantially planar stock feeding base plate, and wherein the substantially planar stock feeding base plate further comprises at least two holes, each of the at least two holes in the substantially planar stock feeding base plate configured to receive the connecting element for removably attaching the stock feeding base plate to the stock feeding guide slot bar.

7. The system of claim 6, wherein the at least two holes in the substantially planar stock feeding base plate are aligned perpendicular to a blade side of the substantially planar stock feeding base plate configured to allow multiple attachment points for coupling the stock feeding guide slot bar to the substantially planar stock feeding base plate.

8. The system of claim 2, further comprising a miter fence adjustably coupled to the stock feeding base plate, the miter fence comprising:

a miter swivel comprising a substantially planar front face; and a fence portion adjustably coupled to the substantially planar front face to permit alignment of the fence relative to the blade of the table saw.

9. The system of claim 8, wherein the fence portion comprises two or more slots configured to receive a connecting element, and wherein the miter swivel comprises two or more holes configured to receive a connecting element to adjustably couple the fence portion to the miter swivel.

* * * * *

UNITED STATES PATENT AND TRADEMARK OFFICE

CERTIFICATE OF CORRECTION

PATENT NO. : 8,661,954 B1
APPLICATION NO. : 13/709830
DATED : March 4, 2014
INVENTOR(S) : William Buss Quayle It is certified that error appears in the above-identified patent and that said Letters Patent is hereby corrected as shown below:

In the Specification

In column 1, line 25, delete “system” and insert --system eliminates--, therefor.

In column 3, line 24, delete “gauge” and insert --fence--, therefor.

In column 3, line 28, delete “gauge” and insert --fence--, therefor.

Signed and Sealed this
First Day of July, 2014

Michelle K. Lee

Michelle K. Lee
*Deputy Director of the United States Patent and Trademark Office*